United States Patent [19]

Gordon

[11] 4,165,293

[45] Aug. 21, 1979

[54] SOLID TRANSPARENT CLEANSER

[75] Inventor: Robert A. Gordon, Jenison, Mich.

[73] Assignee: Amway Corporation, Ada, Mich.

[21] Appl. No.: 929,548

[22] Filed: Jul. 31, 1978

Related U.S. Application Data

[63] Continuation-in-part of Ser. No. 797,048, May 16, 1977, abandoned, which is a continuation-in-part of Ser. No. 700,788, Jun. 29, 1976, abandoned.

[51] Int. Cl.[2] ..... C11D 9/26; C11D 9/60; C11D 10/04; C11D 17/00

[52] U.S. Cl. ..... 252/118; 252/117; 252/121; 252/122; 252/132; 252/134; 252/174; 252/DIG. 16

[58] Field of Search ..... 252/108, 117, 118, 121, 252/122, 132, 134, 174, DIG. 16

[56] References Cited

U.S. PATENT DOCUMENTS

| | | | |
|---|---|---|---|
| 3,562,167 | 2/1971 | Kamen | 252/121 |
| 3,903,008 | 9/1975 | Deweever | 252/118 |
| 3,926,828 | 12/1975 | O'Neill | 252/117 |
| 3,969,259 | 7/1976 | Lages | 252/107 |

OTHER PUBLICATIONS

Davidsohn, J., et al.: Soap Manufacture, vol. 1, published by Interscience Publishers, Inc., New York, 1955, pp. 465–472.

*Primary Examiner*—Dennis L. Albrecht
*Attorney, Agent, or Firm*—Price, Heneveld, Huizenga & Cooper

[57] ABSTRACT

The specification discloses a solid transparent soap employing a greater amount of sodium soap than prior artisans have ever been able to get into a transparent bar without plodding, milling or refining. In excess of 25% sodium tallow soap to as much as 55% sodium soap, based mainly on tallow, is mixed with 10% to 40% anionic or amphoteric surfactant, combinations and/or complexes thereof, and 65% to 15% of a two or six carbon dihydric alcohol. The resulting soap composition is transparent in that one can read 14 point type through a ¼ inch bar and can be made by simple mixing, without plodding, milling or refining.

28 Claims, No Drawings

SOLID TRANSPARENT CLEANSER

CROSS REFERENCE TO RELATED APPLICATION

This is a continuation-in-part of application Ser. No. 797,048 filed on May 16, 1977, entitled SOLID TRANSPARENT CLEANSER, now abandoned, which was a continuation-in-part of application Ser. No. 700,788 filed June 29, 1976, entitled SOLID TRANSPARENT CLEANSER, now abandoned.

BACKGROUND OF THE INVENTION

The present invention relates to solid, transparent soaps. Commonly available transparent soap bars contain some sodium soap, some glycerine, perhaps some other polyhydric alcohol such as sugar, a short chain monohydric alcohol and water. The monohydric alcohol is necessary to facilitate dissolution of the sodium soap in the glycerine. Also, the monohydric alcohol contributes to the transparency. A relatively high content of monohydric alcohol and/or water is required in order to effect dissolution of the sodium soap.

For example, to get as much as about 45% sodium soap into the composition, as much as 30% monohydric alcohol is required. Even then, it is not possible to get any more sodium soap into the composition since higher quantities of sodium soap make the bar cloudy and no longer transparent. A generally accepted test for transparency is that one be able to read 14 point type through a ¼ inch bar of the soap. (See U.S. Pat. No. 3,562,167 patented Feb. 9, 1971.) Another measure of transparency is "translucency voltage" as described in U.S. Pat. No. 2,970,116. It is generally accepted that a soap having a translucency voltage of 30 or less as determined in accordance with the teaching of U.S. Pat. No. 2,970,116 is a transparent soap.

One drawback to the relatively low sodium soap content of prior art bars is that the bar tends to have a relatively short use life. Another problem is created by the monohydric alcohol which is required to dissolve the sodium soap and render the bar transparent. The monohydric alcohol causes shrinkage of the soap in molds on cooling and solidifying. Thus, it is typical for transparent soap to be manufactured by being cast in a large frame, allowed to evaporate several weeks and then cut into bars after the most serious shrinkage has occurred. It is generally not practical to manufacture good quality transparent soap containing monohydric alcohol by casting into individual molds.

Another problem created by the monohydric alcohol is that the soap bars tend to shrink after they are packaged. Packaging in plastic or aluminum wrap is required to reduce evaporation after packaging. Even then, there is a resultant weight loss and one has to actually pack a larger bar into the package than the weight stated on the package in order to compensate for the weight loss which will occur after the packaged bar leaves the factory. The monohydric alcohol is also readily soluble in water and contributes to the short use life of the soap. The scent of the monohydric alcohol also makes it more difficult to perfume the soap in that the alcohol scent interferes with the desired perfume scent. Monohydric alcohols also have relatively low flash points and present a flammability hazard in the manufacturing process.

Another drawback to prior art bars is the difficulty of dissolving additives and still maintain transparency.

Such additives might include perfumes, skin moisturizers and etc.

Some prior artisans have avoided the use of sodium soap by using substantial quantities of other types of soaps. U.S. Pat. Nos. 3,793,214, 3,654,167 and 2,580,713 disclose transparent soaps made from liquid soaps. In U.S. Pat. No. 3,793,214, the liquid soap is reacted during the composition step, rather than being previously reacted and introduced as a component. However, the resulting bars lack long use life and really do not provide broad solutions to the above problems.

U.S. Pat. No. 3,562,167 attempts to minimize the quantity of alcohol, water and other volatiles required by employing a nonionic wetting agent comprising a polyalkylene glycol ether of an alkyl phenol in combination with from about 8% to about 22% sodium soap. A nonionic detergent is used in addition to sodium soap. One drawback to such a composition is that these types of nonionic detergents are harsh, drying, and defatting to the skin. Also, the sodium soap content is relatively low.

Yet another technique for avoiding monohydric alcohols, and still get a higher concentration of sodium soap, is to use rather complicated, elaborate mechanical techniques for getting the sodium soap into solution. These may include milling, plodding, refining or the like.

For example, U.S. Pat. No. 3,969,259 to Lages, Mar. 18, 1974, discloses a higher concentration of sodium soap achieved without monohydric alcohol, but teaches that transparency is achieved only with plodding or equivalent working at a relatively low temperature of 100° F. to 110° F. While such mechanical techniques are well known in the art, they are still costly and are desirably avoided.

Another approach to getting more sodium soap into solution is to use a great deal of water or an oil such as castor oil or both. Unfortunately, such bars tend to be too soft and too subject to shrinkage. Also, usually several weeks of aging, six to eight, may be required before the soap actually becomes transparent.

Sometimes a great deal of glycerine, 5–10%, is added as well as water. This too makes for a mushy bar which has a very strong affinity for water. Glycerine can also sting in higher concentrations.

SUMMARY AND ADVANTAGES OF THE INVENTION

In contrast to the transparent soap bars of the prior art, the present invention comprises a transparent soap bar having a very high percentage of sodium soap, based mainly on tallow and its corresponding fatty acids, formulated by simple mixing without the need for plodding, milling or refining. In mixing the ingredients, we are simply dissolving them without "working" them as in plodding. Specifically, the sodium soap content ranges from higher than any prior art level in a molded, non-plodded, non-milled and non-refined soap to about 55%. This quantity of sodium soap is dissolved in from about 15% to about 65% of a dihydric alcohol. This is made possible through the use of from about 10% to about 40% of an anionic or amphoteric surfactant, or complexes or combinations thereof. Transparent soap bars made in accordance with the composition of this invention passed the standard transparency tests in that one can read 14 point type through a ¼ inch bar, and the bars have translucency voltages of 30 or less.

As a result of this invention, a high soap content can be achieved without the aid of monohydric alcohol or excessive water or excessive mechanical working. Also, no aging is required since the soap is transparent after mixing. Accordingly, the transparent soap of the present invention can be mixed in a simple straightforward mixer and cast into individual bar molds. The shrinkage exhibited with conventional transparent soaps is not experienced with the composition of the present invention.

Similarly, shrinkage and weight loss in the package are at least greatly minimized. The soap composition of the present invention can be formulated to last longer by employing a quantity of sodium soap towards the upper limits of the sodium soap range. In the alternative, one can employ sodium soap in quantities towards the lower end of the range and utilize the additional solublizing power of the composition to add other additives or larger quantities of desired additives.

DESCRIPTION OF THE PREFERRED EMBODIMENT

In the preferred embodiment, from an amount greater than that found in prior art non-plodded, non-milled and non-refined soaps, to 55% sodium soap, 10% to 40% anionic or amphoteric surfactant or complexes or combinations thereof and 65% to 15% of a two to six carbon dihydric alcohol are mixed with additional desired ingredients in a conventional manner with heating and stirring to about 180° F. until clear. A simple batch mixer is employed for the mixing. The optional ingredients are added at some temperature above the mixture's congealing point of approximately 120° F. When the heated mixture is clear, it is poured into individual molds. It can be prepared by pouring into frames which are cut and stamped on cooling, but one advantage of the invention is the ability to pour it into individual molds. The percentage ranges given herein are for the component products as they are commercially available, as will be described more fully hereinbelow.

Naturally, a transparent soap can be made using lower amounts of sodium soap, as for example 22% or less as taught in U.S. Pat. No. 3,562,167 to Kamen. However, this invention enables one to exceed such limits. Thus, the tallow soap component concentration can exceed the 22% figure. Because it is often desirable to add soap components, such as the softer coconut soap, (coco soap), the lower limits discussed herein will refer to the tallow component only.

THE SODIUM SOAP

The sodium soap employed is basically the conventional sodium toilet soap prepared from tallow or its fatty acids. Also, it is preferable that the soap composition include a small quantity of a softer sodium soap such as a coco soap prepared from coconut oil or its fatty acids. A conventionally available tallow/coco (coconut oil) milled soap containing about 80% to 90% of sodium tallow soap and about 10% to 20% sodium coco soap is most preferable.

A percentage of such a sodium soap which can be included in the composition can be as high as 55%. With the addition of 27.5% propylene glycol and 17.5% triethanolamine lauryl sulfate, a clear bar can be made that will pass the 14 point type clarity test.

The soaps employed are those which are commercially available. In understanding the percentage ranges, it must be realized that typical commercially available soaps usually include from 5% to about 12% water.

THE DIHYDRIC ALCOHOL

The dihydric alcohol to be used has two to six carbon atoms. Examples of such dihydric alcohols which can be used include ethylene glycol, diethylene glycol, triethylene glycol, propylene glycol, butylene glycol (2,3-dihydroxy butane), pentamethylene glycol (1,5-pentanediol), hexylene glycol and dipropylene glycol. Propylene glycol is preferred because of its low irritation and toxicity potential and because it is particularly effective in producing clear, transparent bars. The quantity of such alcohol employed ranges from 65% to about 15%.

THE ANIONIC/AMPHOTERIC SURFACTANT

The anionic or amphoteric surfactant is necessary in accordance with the present invention. From 10% to about 40% such surfactant is required. Examples of anionic surfactants which have been found operable include triethanolamine lauryl sulfate and diethanolamine lauryl sulfate. It is readily apparent to those skilled in the art that other anionic surfactants will work equally well and it is only because of the ready availability of these particular anionic surfactants that they were experimented with in conjunction with the present invention.

Examples of amphoteric surfactants which are operable in this invention include the sodium salt of dicarboxyethyl fatty acid derived imidazoline, lauryl betaine (inner salt of (carboxymethyl)-lauryldimethyl ammonium hydroxide), 2-isostearic-1-(ethyl-beta-oxypropanoic acid)-imidazoline, lauraminopropionic acid, sodium lauriminodipropionate, and coco dimethyl betaine. It is readily apparent to those skilled in the art that other amphoteric surfactants will work equally well and it is only becuase of the ready availability of these particular amphoteric surfactants that they were experimented with in conjunction with the present invention.

Amphoteric/anionic complexes or mixtures also provide suitable surfactants. An example of such a product is "Duponol XL" by E. I. duPont de Nemours and Company, which is also disclosed in U.S. Pat. No. 2,833,722 to Funderburk et al, dated May 6, 1958. It is not known for certain whether a chemical complex is formed between the amphoteric and anionic site bearing chemicals or whether the two types of chemicals are merely mixed. Thus, the term complex as used herein refers more to the effect achieved than to the chemical structure of the composition per se. In any event, amphoteric/anionic sulfate complexes, including amphoteric/anionic alkyl sulfate have been found specifically operable. Amphoteric 6 (Cosmetic, Toiletry and Fragrance Association, Cosmetic Ingredient Dictionary Terminology, First Edition 1973) is a more specific example. Amphoteric 6 is an amphoteric/anionic alkyl sulfate complex. It is a long chain imidazoline type of zwitterion conforming generally to the formula:

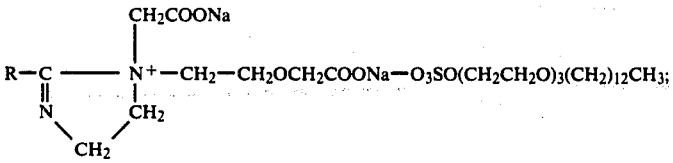

where R is derived from the coconut fatty acid radical.

As with most liquid commercial ionic surfactants, the above mentioned surfactants contain from about 50% to about 70% water. The formula specification calling for 10% to 40% anionic or amphoteric surfactant refers to a 50% to 70% water solution thereof.

Cationic surfactants per se are inoperable in the present invention. (Small quantities may be added as germicides.) Accordingly, it is clear that the amphoteric surfactants employed herein are acting as anionic materials on the alkaline side of their isoelectric range in the compositions. Nonionic surfactants are apparently nonoperable or of limited operability as is indicated by the maximum sodium soap content of 22% in U.S. Pat. No. 3,562,167.

There does not appear to be a specific relationship required between the sodium soap and surfactant contents. The surfactant is acting as a clarifying agent in the mixture and surfactant content varies with each formula depending upon the dihydric alcohol and other ingredients used in the formulation as well as processing variables and the sodium soap content. The precise relationship between the three main ingredients will thus be determined by some empirical observations in each specific case.

The anionic and amphoteric surfactants or complexes thereof yield an additional plus in the composition, over and above their effect of making it possible to employ large quantities of sodium soap. They tend to provide a smooth feeling on the skin and they make the bars more versatile in hard water than conventional soap bars, either transparent or opaque. Also, they actually appear to suppress the pH of the soap. The pH of soap compositions made in accordance with this invention are around 9 versus the normal 10.

MISCELLANEOUS

Monohydric alcohols are not required in the present invention to produce a clear bar. While some monohydric alcohol might be employed, it would be in small quantities of certainly less than 5%. This facilitates avoidance of mold shrinkage, weight loss and short use life problems.

It is also unnecessary to add water to the composition of the present invention. Naturally, there is some water present as would be expected by one employing most commercial soaps and surfactants. It can be calculated that the water inherently present would amount to approximately 10% to 25%, although some of the water present, particularly in the surfactants employed in mixing the composition, would tend to be evaporated off during the composition mixing and heating stages. This low water content is desirable since it also increases the useful life of the bar.

Perfumes, coloring agents, emollients, moisturizers, skin conditioners, keratolytic agents, germicides, deodorants, foam stabilizers and hair conditioners are examples of additives which can be optionally incorporated. These can be added when the sodium soap is present in quantities towards its upper limit, but more can be added when the quantity of sodium soap employed is towards the lower limits of the range. The amounts of each such ingredient might be very slight. The total of such added ingredients certainly would not exceed 10% by weight of the bar, as is appreciated by those skilled in the art. Glycerine could also be added for cosmetic purposes.

TRANSLUCENCY VOLTAGE RESULTS

The following examples illustrate the excellent transparency of bars made in accordance with the present invention and also illustrate the fact that transparency is not strictly a function of the quantity of sodium soap present in the system:

| | TALLOW/ COCO SOAP | DIHYDRIC ALCOHOL | ANIONIC, AMPHOTERIC SURFACTANTS OR COMPLEXES THEREOF | TRANSLUCENCY VOLTAGE |
|---|---|---|---|---|
| 1. | 80/20 at 40% | propylene glycol at 30% | coco dimethyl betaine at 30% | 13.80 |
| 2. | 80/20 at 35% | ethylene glycol at 37% | triethanolamine lauryl sulfate at 28% | 9.2 |
| 3. | 90/10 at 25% | propylene glycol at 65% | triethanolamine lauryl sulfate at 10% | 23.9 |
| 4. | 80/20 at 25% | propylene glycol at 55% | triethanolamine lauryl sulfate at 20% | 24.15 |
| 5. | 80/20 at 55% | propylene glycol at 27.5 | triethanolamine lauryl sulfate at 17.5% | 17.83 |

Surprisingly, those of the above formulations with lower percentages of sodium soap actually were not as transparent as those with higher quantities of sodium soap. In all examples, only straightforward mixing was done. Plodding, milling and refining were not employed.

LIFE USE EXAMPLES

In the following examples, a group of individuals were randomly selected to use bars of soap made in accordance with this invention and a conventional commercially available transparent soap bar. As above, only simple mixing was employed in preparing the transparent soap bars of these examples. The fourth column below indicates the average weight loss per use in grams:

| | TALLOW/ COCO SOAP | DIHYDRIC ALCOHOL | ANIONIC, AMPHOTERIC SURFACTANTS OR COMPLEXES THEREOF | WEIGHT LOSS PER USE |
|---|---|---|---|---|
| 6. | 90/10 at 50% | propylene glycol at 30% | triethanolamine lauryl sulfate at 20% | .62–.68 gm |
| 7. | 90/10 at 55% | propylene glycol at 27.5 | triethanolamine lauryl sulfate at 17.5% | .62–.68 gm |
| 8. | monohydric alcohol based glycerine and honey transparent soap bar (45% sodium soap, 25% alcohol) | | | 1.18 gm |

MISCELLANEOUS EXAMPLES

In all of the following miscellaneous examples except 18, all of the transparent bars produced had translucency voltages of under 30. As above, mixing was simple, and no plodding, milling or refining were employed in producing the transparent bars of these examples. 14 point type could be read through ¼ inch bars of each:

| | TALLOW/ COCO SOAP | DIHYDRIC ALCOHOL | ANIONIC, AMPHOTERIC SURFACTANTS OR COMPLEXES THEREOF |
|---|---|---|---|
| 1. | 80/20 at 35% | propylene glycol at 35% | coco dimethyl betaine at 30% |
| 2. | 85/15 at 2-isostearic-1-(ethyl- | propylene glycol at 35% | 2-isostearic-1-)ethyl-beta-oxypropanoic acid)-imidazoline at 25% |
| 3. | 80/20 at 35% | propylene glycol at 35% | diethanolamine lauryl sulfate at 30% |
| 4. | 80/20 at 35% | propylene glycol at 30% | lauryl betaine at 10% and diethanolamine lauryl sulfate at 25% |
| 5. | 90/10 at 35% | ethylene glycol at 40% | 2-isostearic-1-(ethyl-beta-oxypropanoic acid-imidazoline at 25% |
| 6. | 90/10 at 35% | triethylene glycol at 40% | 2-isostearic-1-(ethyl-beta-oxypropanoic acid)-imidazoline at 25% |
| 7. | 80/20 at 40% | diethylene glycol at 30% | coco dimethyl betaine at 30% |
| 8. | 90/10 at 35% | dipropylene glycol at 40% | 2-isostearic-1-(ethyl-beta-oxypropanoic acid)-imidazoline at 25% |
| 9. | 80/20 at 35% | propylene glycol at 35% | lauryl betaine at 30% |
| 10. | 80/20 at 35% | propylene glycol at 35% | amphoteric/anionic alkyl sulfate complex at 30% |
| 11. | 80/20 at 40% | propylene glycol at 30% | amphoteric/anionic sulfate complex at 30% |
| 12. | 80/20 at 40% | propylene glycol at 40% | sodium salt of dicarboxyethyl fatty acid derived imidazoline at 20% |
| 13. | 80/20 at 40% | propylene glycol at 15% | triethanolamine lauryl sulfate at 20% and amphoteric/anionic alkyl sulfate at 20% |
| 14. | 80/20 at 40% | hexylene glycol at 30% | coco dimethyl betaine at 30% |
| 15. | 85/15 at 30% | propylene glycol at 40% | lauraminopropionic acid at 30% |
| 16. | 85/15 at 30% | propylene glycol at 40% | sodium lauriminodipropionate at 30% |
| 17. | 100% sodium stearate at 50% | propylene glycol at 30% | T.E.A.-lauryl sulfate at 20% |
| 18. | 100% sodium stearate at 40% | propylene glycol at 40% | amphoteric 2 (CTFA Cosmetic Ingredient Dictionary Terminology) at 20% |

-continued

| | TALLOW/ COCO SOAP | DIHYDRIC ALCOHOL | ANIONIC, AMPHOTERIC SURFACTANTS OR COMPLEXES THEREOF |
|---|---|---|---|
| | (The bar of this example was not as clear as desired and some inversion in relative proportions of surfactant, glycol and soap would probably be desirable.) | | |
| 19. | 80/20 at 40% | hexylene glycol at 30% | amphoteric 6 (CTFA Cosmetic Ingredient Dictionary Terminology) at 30% |
| | (The addition of about 3% water to this variation is helpful in obtaining maximum clarity.) | | |
| 20. | 100% at 25% | propylene glycol at 65% | triethanolamine lauryl sulfate at 10% |
| 21. | 85/15 at 30% | propylene glycol at 30% | triethanolamine lauryl sulfate at 40% |
| 22. | 85/15 at 30% | propylene glycol at 30% | amphoteric/anionic alkyl sulfate at 40% |
| 23. | 85/15 at 30% | propylene glycol at 30% | coco dimethyl betaine at 40% |

NONIONIC SURFACTANT EXAMPLES OPAQUE BARS

The examples below were prepared as above, but used nonionic surfactants. None resulted in transparent bars, even with 3% more water added. Of course, plodding, milling, refining or other mechanical working was not employed, but such is not necessary to produce clear bars in accordance with the present invention.

| | TALLOW/ COCO SOAP | DIHYDRIC ALCOHOL | NONIONIC SURFACTANT |
|---|---|---|---|
| 1. | 85/15 at 40% | propylene glycol at 35% | nonoxynol 10 (CTFA Cosmetic Ingredient Dictionary Terminology) at 25% |
| 2. | 85/15 at 40% | propylene glycol at 35% | octoxynol 9, commercially known as "Triton X-100" (CTFA Cosmetic Ingredient Dictionary Terminology) at 25% |
| 3. | 100% at 25% | propylene glycol at 45% | octoxynol 9, commercially known as "Triton X-100" (CTFA Cosmetic Ingredient Dictionary Terminology) at 30% |

SURFACTANT MIXTURE EXAMPLES

In these examples, a nonionic surfactant was mixed with an anionic surfactant. A 100% sodium tallow soap was employed at a level of 25%. No plodding, milling, or refining were employed, only simple mixing.

Interestingly, the example in which the nonionic level was within the prior art and the anionic level was below the 10% required in this invention did not produce a transparent bar. However as soon as the anionic level was brought to 10%, a transparent bar was produced.

| | 100% TALLOW SOAP | DIHYDRIC ALCOHOL | NONIONIC SURFACTANT | ANIONIC SURFACTANT |
|---|---|---|---|---|
| 1. | 25% | propylene glycol at 45% | octoxynol 9 (Triton X-100 see above) at 21% | triethanolamine lauryl sulfate at 9% |
| Comment: The bar produced was translucent, but one could not read 14 point type through ¼inch thickness. | | | | |
| 2. | 25% | propylene glycol at 45% | octonxynol 9 (Triton X-100, see above) at 20% | triethanolamine lauryl sulfate at 10% |
| Comment: The bar produced was transparent and 14 point type could be read through a ¼inch thickness. | | | | |

TRIHYDRIC ALCOHOL EXAMPLES OPAQUE BARS

A trihydric alcohol in the $C_2$–$C_6$ carbon group does not produce the results achieved with a dihydric alcohol. In all of the following examples, the bar produced was opaque and generally too soft.

| | TALLOW/ COCO SOAP | TRIHYDRIC ALCOHOL | ANIONIC, AMPHOTERIC SURFACTANTS OR COMPLEXES THEREOF |
|---|---|---|---|
| 1. | 85/15 at 55% | glycerine at 27.5 | triethanolamine lauryl sulfate at 17.5 |
| 2. | 85/15 at 50% | glycerine at 30% | dicarboxyethyl fatty acid derived imidazoline at 20% |
| 3. | 85/15 at 40% | glycerine at 40% | sodium lauraminopropionate at 20% |

Only at the extreme end of the scale was a clear bar obtained, but it was only moderately solid:

| | | | |
|---|---|---|---|
| 4. | 85/15 at 25% | glycerine at 65% | triethanolamine lauryl sulfate at 10% |

While plodding, milling or refining might have made the bars of these examples transparent, such steps were not employed for purposes of these steps since such steps are not necessary to create the transparent soap bars of the present invention.

CONCLUSION

In conclusion, the examples and description illustrate the many advantages of the present invention. A high soap content, no monohydric alcohol, low water content, transparent soap bar can be made without plodding, milling, refining or other more expensive working of the soap. It can be poured into individual bar molds. It has a very good life use and undergoes a minimum of shelf life shrinkage.

Of course, it is understood that the above is merely a preferred embodiment of the invention and various changes and alterations can be made without departing from the spirit and broader aspects of the invention.

The embodiments of the invention in which an exclusive property or privilege is claimed are defined as follows:

1. A transparent soap bar consisting essentially of about 25% to about 55% sodium soap based mainly on tallow or its corresponding fatty acids, where the tallow or corresponding fatty acid soap component alone is at least 25%; about 10% to about 40% of one of an anionic surfactant, an amphoteric surfactant and combinations and complexes thereof; about 15% to about 65% of a two to six carbon dihydric alcohol; said bar being substantially free of monohydric short chain alcohols.

2. The transparent soap bar of claim 1 in which the sodium soap includes about 10% to about 20% coconut oil soap.

3. The transparent soap bar of claim 1 in which said sodium soap comprises a tallow/coconut oil soap mixture.

4. The transparent soap bar of claim 3 in which said surfactant is selected from the group consisting of: triethanolamine lauryl sulfate; diethanolamine lauryl sulfate; sodium salt of dicarboxyethyl fatty acid derived imidazoline; lauryl betaine (inner salt of (carboxymethyl)lauryldimethyl ammonium hydroxide); 2-isostearic-1-(ethylbeta-oxypropanoic acid)-imidazoline; coco dimethyl betaine; lauraminopropionic acid; sodium lauriminodipropionate; amphoteric/anionic sulfate complexes; and combinations and complexes thereof.

5. The transparent soap bar of claim 4 in which said dihydric alcohol comprises two to six carbon chain length monomers and their relatively low molecular weight polymers selected from the group consisting of: ethylene glycol; diethylene glycol; triethylene glycol; propylene glycol; dipropylene glycol; butylene glycol; pentamethylene glycol; hexylene glycol; and mixtures thereof.

6. The transparent soap bar of claim 4 in which said dihydric alcohol comprises propylene glycol.

7. The transparent soap bar of claim 5 which includes one or more of the following additional ingredients: perfumes, coloring agents, emollients, moisturizers, skin conditioners, keratolytic agents, germicides, deodorants, foam stabilizers and hair conditioners cumulatively not exceeding 10% by weight of the total bar weight.

8. The transparent soap bar of claim 1 in which said surfactant is selected from the group consisting of: triethanolamine lauryl sulfate; diethanolamine lauryl sulfate; sodium salt of dicarboxyethyl fatty acid derived imidazoline; lauryl betaine (inner salt of (carboxymethyl)lauryldimethyl ammonium hydroxide); 2-isostearic-1-(ethylbeta-oxypropanoic acid)-imidazoline; coco dimethyl betaine, lauraminopropionic acid; sodium lauriminodipropionate; amphoteric/anionic sulfate complexes and combinations and complexes thereof.

9. The transparent soap bar of claim 1 in which said dihydric alcohol comprises two to six carbon chain length monomers and their relatively low molecular weight polymers selected from the group consisting of: ethylene glycol; diethylene glycol; triethylene glycol; propylene glycol; dipropylene glycol; butylene glycol; pentamethylene glycol; hexylene glycol; and mixtures thereof.

10. The transparent soap bar of claim 1 in which said dihydric alcohol comprises propylene glycol.

11. The transparent soap bar of claim 1 which includes one or more of the following additional ingredients: perfumes, coloring agents, emollients, moisturizers, skin conditioners, keratolytic agents, germicides, deodorants, foam stabilizers and hair conditioners cumulatively not exceeding 10% by weight of the total bar weight.

12. A method for producing transparent soap bars comprising: mixing from about 25% to about 55% of a sodium soap based mainly on tallow or its fatty acids, where the tallow or corresponding fatty acid soap component alone is at least 25%, with about 10% to about 40% of one of an anionic surfactant, an amphoteric surfactant and combinations and complexes thereof and with about 15% to about 65% of a two to six carbon dihydric alcohol with stirring and heating to about 180° F.; keeping said mixture substantially free of monohydric short chain alcohols; pouring the resulting heated mixture into suitable molds for processing into individual bars.

13. The method of claim 12 in which said step of pouring said composition into a suitable mold comprises: pouring said composition into individual bar molds whereby no further cutting or stamping is required to create a plurality of individual soap bars.

14. The method of claim 13 in which additional ingredients are added to said mixture after it reaches a temperature of about approximately 120° F. and prior to pouring the resulting heated composition into molds.

15. The method of claim 13 in which the sodium soap includes about 10% to about 20% coconut oil soap.

16. The method of claim 13 in which said sodium soap comprises a tallow/coconut oil soap mixture.

17. The method of claim 16 in which said surfactant is selected from the group consisting of: triethanolamine lauryl sulfate; diethanolamine lauryl sulfate; sodium salt of dicarboxyethyl fatty acid derived imidazoline; lauryl betaine (inner salt of (carboxymethyl)-lauryldimethyl ammonium hydroxide); 2-isostearic-1-(ethyl-beta-oxypropanoic acid)-imidazoline; coco dimethyl betaine; lauraminopropionic acid; sodium lauriminodipropionate; amphoteric/anionic sulfate complexes; and combinations and complexes thereof.

18. The method of claim 17 in which said dihydric alcohol comprises two to six carbon chain length monomers and their relatively low molecular weight polymers selected from the group consisting of: ethylene glycol; diethylene glycol; triethylene glycol; propylene glycol; dipropylene glycol; butylene glycol; pentamethylene glycol; hexylene glycol; and mixtures thereof.

19. The method of claim 17 in which said dihydric alcohol comprises propylene glycol.

20. The method of claim 18 which includes one or more of the following additional ingredients: perfumes, coloring agents, emollients, moisturizers, skin conditioners, keratolytic agents, germicides, deodorants, foam stabilizers and hair conditioners cumulatively not exceeding 10% by weight of the total bar weight.

21. The method of claim 13 in which said surfactant is selected from the group consisting of: triethanolamine lauryl sulfate; diethanolamine lauryl sulfate; sodium salt of dicarboxyethyl fatty acid derived imidazoline; lauryl betaine (inner salt of (carboxymethyl)-lauryldimethyl ammonium hydroxide); 2-isostearic-1-(ethyl-beta-oxypropanoic acid)-imidazoline; coco dimethyl betaine; lauraminopropionic acid; sodium lauriminodipropionate; amphoteric/anionic sulfate complex; and combinations and complexes thereof.

22. The method of claim 13 in which said dihydric alcohol comprises two to six carbon chain length monomers and their relatively low molecular weight polymers selected from the group consisting of: ethylene glycol; diethylene glycol; triethylene glycol; propylene glycol; dipropylene glycol; butylene glycol; pentamethylene glycol; hexylene glycol; and mixtures thereof.

23. The method of claim 13 in which said dihydric alcohol comprises propylene glycol.

24. The method of claim 13 which includes one or more of the following additional ingredients: perfumes, coloring agents, emollients, moisturizers, skin conditioners, keratolytic agents, germicides, deodorants, foam stabilizers and hair conditioners cumulatively not exceeding 10% by weight of the total bar weight.

25. The method of claim 12 in which additional ingredients are added to said mixture after it reaches a temperature of above approximately 120° F. and prior to pouring the resulting heated composition into molds.

26. The method claim 12 in which said surfactant is selected from the group consisting of: triethanolamine lauryl sulfate; diethanolamine lauryl sulfate; sodium salt of dicarboxyethyl fatty acid derived imidazoline; lauryl betaine (inner salt of (carboxymethyl)-lauryldimethyl ammonium hydroxide); 2-isostearic-1-(ethyl-beta-oxypropanoic acid)-imidazoline; coco dimethyl betaine, lauraminopropionic acid; sodium lauriminodipropionate; amphoteric/anionic sulfate complexes; and combinations and complexes thereof.

27. The method of claim 26 in which said dihydric alcohol comprises two to six carbon chain length monomers and their relatively low molecular weight polymers selected from the group consisting of: ethylene glycol; diethylene glycol; triethylene glycol; propylene glycol; dipropylene glycol; butylene glycol; pentamethylene glycol; hexylene glycol; and mixtures thereof.

28. The method of claim 26 in which said dihydric alcohol comprises propylene glycol.

* * * * *

UNITED STATES PATENT AND TRADEMARK OFFICE

CERTIFICATE OF CORRECTION

PATENT NO. : 4,165,293

DATED : August 21, 1979

INVENTOR(S) : Robert A. Gordon

It is certified that error appears in the above-identified patent and that said Letters Patent are hereby corrected as shown below:

Example No. 5 under "Translucency Voltage Results", Column Title "Dihydric Alcohol":

"27.5" should be -- 27.5% --

Example No. 2 under "Miscellaneous Examples", Column Title "Tallow/Coco Soap":

Delete "2-isostearic-1-(ethyl-" and substitute -- 40% --

Example No. 2 under "Miscellaneous Examples", Column Title "Anionic, Amphoteric Surfactants or Complexes Thereof":

"isostearic-1-)ethyl-" should be -- isostearic-1-(ethyl- -- and the phrase "imidazoline at 25%" should be moved up one line Example No. 1 under "Trihydric Alcohol Examples Opaque Bars", Column Title "Trihydric Alcohol", Column II:

"27.5" should be -- 27.5% --

Example No. 1 under "Trihydric Alcohol Examples Opaque Bars" Column Title "Anionic, Amphoteric Surfactants or Complexes Thereof", Column III:

"17.5" should be -- 17.5% --

UNITED STATES PATENT AND TRADEMARK OFFICE

CERTIFICATE OF CORRECTION

PATENT NO. : 4,165,293

DATED : August 21, 1979

INVENTOR(S) : Robert A. Gordon

It is certified that error appears in the above-identified patent and that said Letters Patent are hereby corrected as shown below:

Column 11, Line 60:

"(carboxymethyl)lauryldimethyl" should be
-- (carboxymethyl)-lauryldimethyl --

Column 11, Line 61:

"(ethylbeta-oxypropanoic acid)" should be
--(ethyl-beta-oxypropanoic acid) --

Column 12, Line 31:

"(carboxymethyl)lauryldimethyl" should be
-- (carboxymethyl)-lauryldimethyl --

Column 12, Line 32:

"(ethylbeta-oxypropanoic acid)" should be
-- (ethyl-beta-oxypropanoic acid) --

Signed and Sealed this

*Twelfth* Day of *February 1980*

[SEAL]

*Attest:*

SIDNEY A. DIAMOND

*Attesting Officer*

*Commissioner of Patents and Trademarks*